US011143205B2

(12) United States Patent
Oda et al.

(10) Patent No.: US 11,143,205 B2
(45) Date of Patent: Oct. 12, 2021

(54) COMPRESSOR

(71) Applicant: MITSUBISHI HEAVY INDUSTRIES COMPRESSOR CORPORATION, Tokyo (JP)

(72) Inventors: Takashi Oda, Hiroshima (JP); Daisuke Hirata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 128 days.

(21) Appl. No.: 16/775,701

(22) Filed: Jan. 29, 2020

(65) Prior Publication Data

US 2020/0248713 A1 Aug. 6, 2020

(30) Foreign Application Priority Data

Feb. 1, 2019 (JP) ..... JP2019-016838

(51) Int. Cl.

| | |
|---|---|
| ***F04D 29/62*** | (2006.01) |
| ***F04D 17/12*** | (2006.01) |
| ***F04D 29/08*** | (2006.01) |
| ***F04D 29/42*** | (2006.01) |
| ***F04D 29/60*** | (2006.01) |

(52) U.S. Cl.

CPC ..... *F04D 29/624* (2013.01); *F04D 17/122* (2013.01); *F04D 29/083* (2013.01); *F04D 29/422* (2013.01); *F04D 29/4206* (2013.01); *F04D 29/4213* (2013.01); *F04D 29/601* (2013.01); *F05B 2240/14* (2013.01); *F05B 2240/91* (2013.01); *F05B 2260/301* (2013.01)

(58) Field of Classification Search

None

See application file for complete search history.

(56) References Cited

U.S. PATENT DOCUMENTS

| | | | | |
|---|---|---|---|---|
| 2,527,845 A * | 10/1950 | Peterson | F28D 11/02 62/160 |
| 4,715,778 A * | 12/1987 | Katayama | F04D 29/624 415/104 |
| 2014/0178183 A1* | 6/2014 | Masuda | F04D 29/622 415/173.1 |

FOREIGN PATENT DOCUMENTS

| | | | |
|---|---|---|---|
| CN | 107956745 A | 4/2018 | |
| JP | 2001254697 A * | 9/2001 | F04D 29/083 |
| JP | 5868646 B2 | 2/2016 | |
| WO | 2019-207761 A1 | 10/2019 | |

* cited by examiner

*Primary Examiner* — Juan G Flores

(74) *Attorney, Agent, or Firm* — Osha Bergman Watanabe & Burton LLP

(57) ABSTRACT

A compressor 1 includes a base 10 that is fixed on a foundation F and supports a compressor main body 20 from below in a vertical direction Dv, and a connecting part that detachably connects the compressor main body 20 and the base 10 to each other. The compressor main body 20 includes a suction-side protruding pipe 28A and a discharge-side protruding pipe 28B that communicate between an inside and an outside of a casing 21 and protrude outward from an outer peripheral surface of the casing 21. The base 10 includes a support base 11 having a support surface 11*f* for supporting a lower part of the casing 21, and a suction port 12 that extends downward from the support base 11 in the vertical direction Dv and has a through-hole into which the suction-side protruding pipe 28A is inserted.

8 Claims, 5 Drawing Sheets

COMPRESSOR

BACKGROUND OF THE INVENTION

Field of the Invention

The present invention relates to a compressor.

Priority is claimed on Japanese Patent Application No. 2019-016838, filed on Feb. 1, 2019, the content of which is incorporated herein by reference.

Description of Related Art

As a compressor in which a rotor that is rotatably driven around an axis is accommodated in an interior of a casing, there is a centrifugal compressor that compresses a gas using a centrifugal force. In the centrifugal compressor, there are a type with a casing that can be divided into upper and lower parts and a type with a tubular casing that cannot be divided into upper and lower parts and is opened at both ends. The compressor including the casing that cannot be divided into upper and lower parts includes components other than the casing, that is, an internal unit in which a rotor, a bearing, a seal member, and the like are integrally configured. The internal unit is accommodated in the casing.

Incidentally, in a case where maintenance of the compressor including such an internal unit is performed, the internal unit is pulled out from an opening formed at one end of the tubular casing. Therefore, it is necessary to secure sufficient space for pulling out the internal unit in a region adjacent to a position where the compressor is installed. Further, pulling out the internal unit from the casing in a horizontal direction may become difficult.

On the other hand, Japanese Patent No. 5868646 discloses a configuration in which a casing can be divided into upper and lower parts in a compressor including an internal unit. This casing has an upper half on an upper side and a lower half on a lower side. In the internal unit, a rotor that can rotate around an axis, a bearing part that rotatably supports the rotor, and an annular seal part that seals a gap surrounding a circumferential surface of the rotor so as to enable the rotor to rotate are at least integrally configured. According to such a configuration, after removing the upper half of the casing, the internal unit is lifted out from the lower half of the casing. Thereafter, a new internal unit is lowered into and mounted on the lower half of the casing, whereby it is possible to replace components of an interior of the compressor collectively.

SUMMARY OF THE INVENTION

However, even in the configuration disclosed in Japanese Patent No. 5868646, it is necessary to place, during maintenance, the upper half of the casing removed to take out the internal unit near a position where the compressor is installed. Therefore, it is necessary to secure sufficient space in the vicinity of the compressor. In addition, since it takes time and effort to perform a work for detaching the upper half of the casing from the lower half of the casing, there is room for improvement in maintainability.

The present invention provides a compressor which can improve maintainability.

According to a first aspect of the present invention, there is provided a compressor including: a compressor main body; a base that is fixed on a foundation and supports the compressor main body from below in a vertical direction; and a connecting part that detachably connects the compressor main body and the base to each other, in which the compressor main body includes a tubular casing, a rotor that is provided within the casing and is rotatable around an axis, a bearing part that rotatably supports the rotor with respect to the casing, and a protruding pipe that allows a communication between an inside and an outside of the casing and protrudes outward from an outer peripheral surface of the casing, and the base includes a support base having a support surface for supporting a lower part of the casing, and a connection pipe that extends downward from the support base in the vertical direction and has a through-hole into which the protruding pipe is insertable.

With such a configuration, the compressor main body is supported on the support surface of the base fixed to the foundation. Therefore, during maintenance, the compressor main body can be removed directly from the base by being lifted from the support surface of the base. In this way, when removing the compressor main body, there is no need to remove other components or move the compressor main body in a horizontal direction. As a result, a space that has to be secured for maintenance around the compressor can be reduced. Further, since the compressor main body removed from the base includes the tubular casing, handling such as transportation can be easily performed. When the compressor main body is mounted to the base, in a case where the protruding pipe of the compressor main body is inserted into the connection pipe of the base, a fluid compressed in the compressor main body can enter and exit the casing through the protruding pipe and the connection pipe. Therefore, the compressor can be used after maintenance without performing a complicated connection work to the foundation.

In a compressor according to a second aspect of the present invention, according to the first aspect, there is further provided a seal member that seals between an outer peripheral surface of the protruding pipe and an inner peripheral surface of the connection pipe.

With such a configuration, it is possible to prevent the fluid from leaking from between the protruding pipe and the connection pipe by the seal member only by inserting the protruding pipe of the compressor main body into the connection pipe of the base.

In a compressor according to a third aspect of the present invention, according to the first or second aspect, the base may further include a recess that is recessed downward in the vertical direction and into which the casing is fitted, and the support surface may be formed at least on part of the recess.

With such a configuration, when the compressor main body is placed on the base, the lower part of the casing of the compressor main body may be fitted into the recess, and the compressor main body can be easily positioned with respect to the base.

In a compressor according to a fourth aspect of the present invention, according to any one of the first to third aspects, the casing may have a pair of flange parts protruding from the outer peripheral surface in a horizontal direction, and the base may have a pair of receiving parts on which the pair of flange parts is placed.

With such a configuration, the compressor main body can be easily positioned with respect to the base by placing the pair of flange parts of the casing in the pair of receiving parts of the base.

According to the present invention, it is possible to improve maintainability of the compressor.

DETAILED DESCRIPTION OF THE INVENTION

Hereinafter, an embodiment of a compressor according to the present invention will be described with reference to the accompanying drawings. However, the present invention is not limited only to the embodiment.

Figure 1:
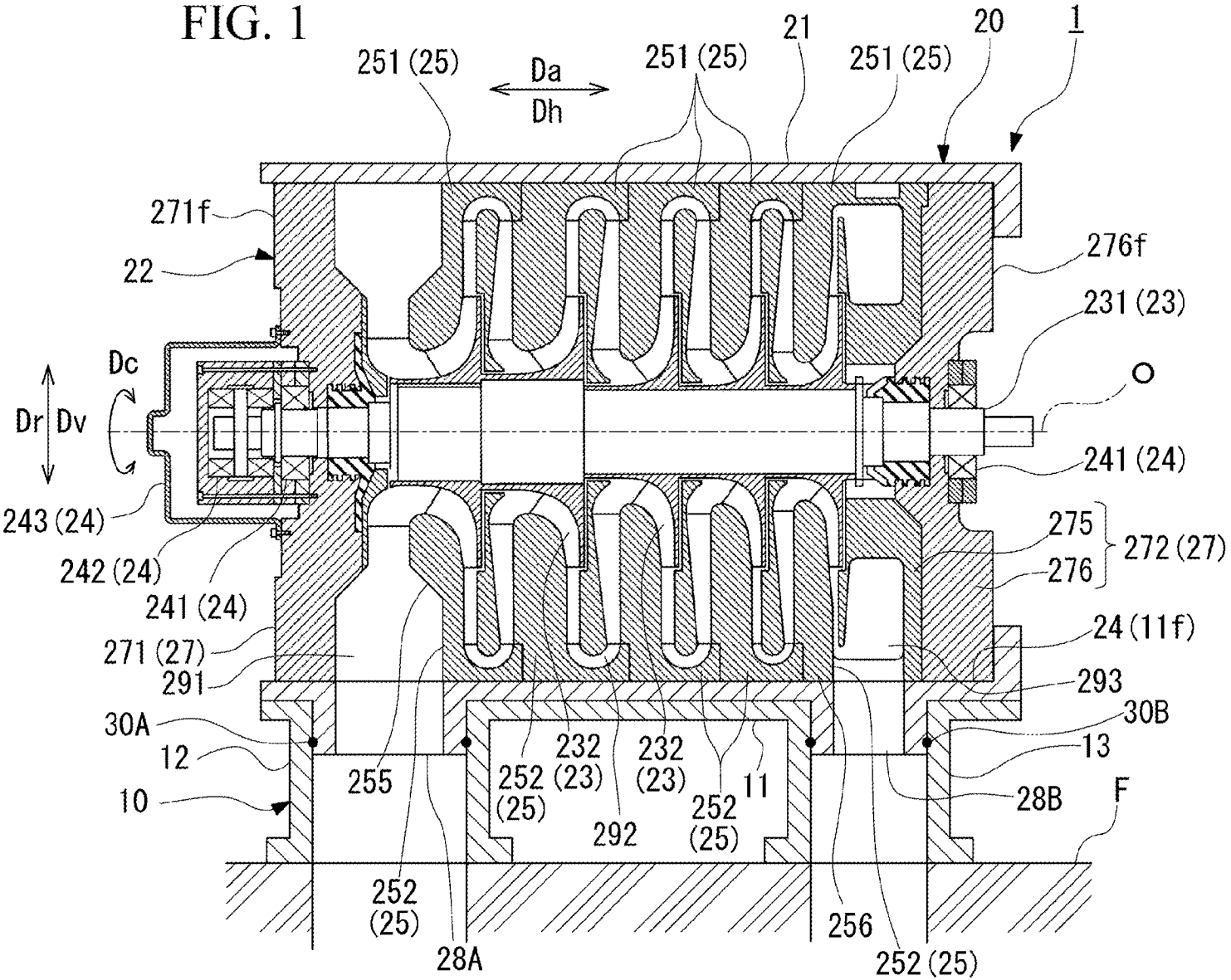
FIG. 1 is a cross-sectional view schematically showing a configuration of a compressor according to an embodiment of the present invention.
Figure 2:
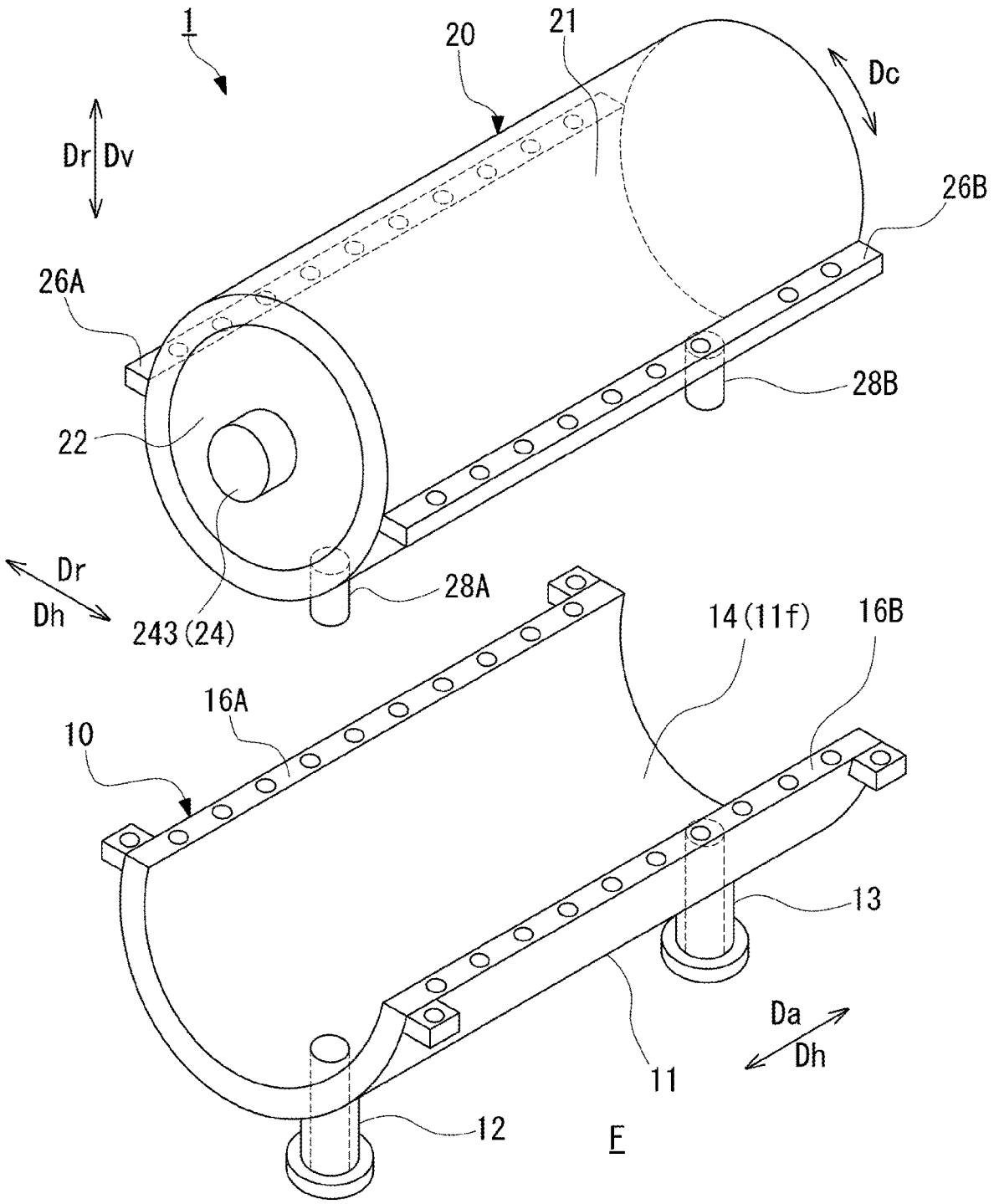
FIG. 2 is a perspective exploded view schematically showing the configuration of the compressor according to the embodiment of the present invention.
Figure 3:
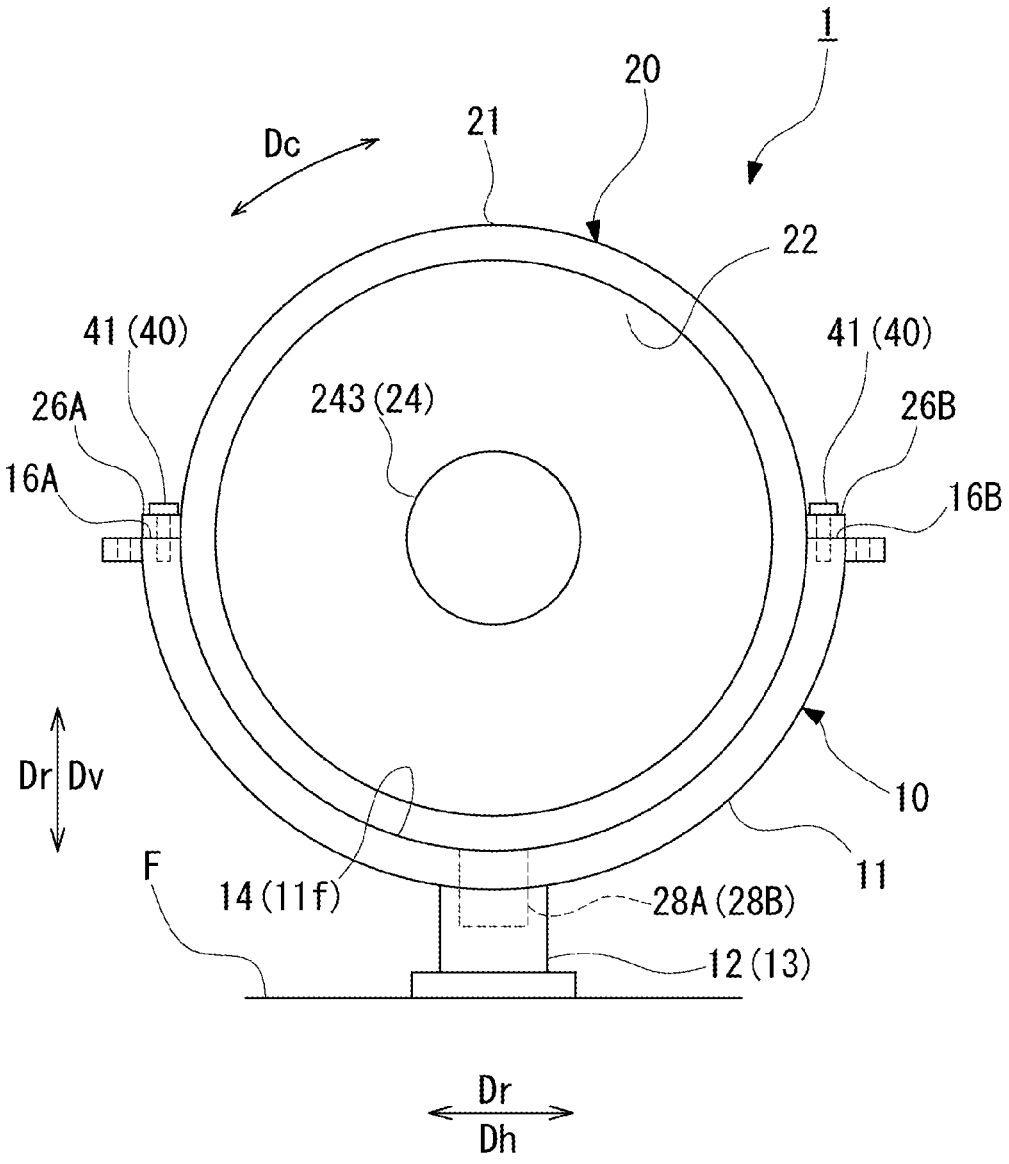
FIG. 3 is a side view schematically showing a state when the compressor according to the embodiment of the present invention is viewed from one side in an axial direction.

FIG. 1 is a cross-sectional view schematically showing a configuration of a compressor according to an embodiment of the present invention. FIG. 2 is a perspective exploded view schematically showing the configuration of the compressor according to the embodiment of the present invention. FIG. 3 is a side view schematically showing a state when the compressor according to the embodiment of the present invention is viewed from one side in an axial direction.

As shown in FIG. 1, a compressor 1 of the present embodiment is a single-shaft multistage centrifugal compressor (multistage centrifugal compressor) including a plurality of impellers 232. As shown in FIGS. 1 to 3, the compressor 1 of the present embodiment includes a base 10, a compressor main body 20, and a connecting part 40 (see FIG. 3).

Hereinafter, a direction in which an axis O of a rotor 23 (described later) extends is referred to as an axial direction Da. A radial direction with the axis O as a reference is simply referred to as a radial direction Dr. An up and down direction as viewed in the drawings of FIGS. 1 and 3, out of the radial directions Dr perpendicular to the axis O, is referred to as a vertical direction Dv. In addition, a left and right direction in FIGS. 1 and 3, which is the radial direction Dr perpendicular to the axis O and the axial direction Da, is referred to as a horizontal direction Dh. A direction around the rotor 23 with the axis O as the center is referred to as a circumferential direction Dc.

The base 10 is fixed on the foundation F. The base 10 supports the compressor main body 20 from below in the vertical direction Dv. The base 10 includes a support base 11, a suction port (connection pipe) 12, and a discharge port (connection pipe) 13.

As shown in FIGS. 2 and 3, the support base 11 has a semi-ring shape having a section orthogonal to the axis O with the axis O as the center. The support base 11 has the same shape and extends in the axial direction Da. The support base 11 includes a recess 14 that is recessed downward in the vertical direction Dv and into which a lower part of the compressor main body 20 is fitted. The recess 14 is open upward in the vertical direction Dv. The support base 11 has a support surface 11*f* that supports the compressor main body 20 at least on part of the recess 14. The support surface 11*f* in the present embodiment is an inner peripheral surface of the support base 11 and an entire surface that forms the recess 14. In this way, the support base 11 covers the outer peripheral surface of the lower side of the compressor main body 20 accommodated in the interior thereof from below.

The support base 11 is formed with a first receiving part (receiving part) 16A and a second receiving part (receiving part) 16B as a pair of receiving parts at both ends in the circumferential direction Dc. The first receiving part 16A and the second receiving part 16B are formed in a shape in which a first flange part 26A and a second flange part 26B (described later) can be placed. Specifically, the first receiving part 16A and the second receiving part 16B are each formed by a plane that faces upward in the vertical direction Dv. Each of the first receiving part 16A and the second receiving part 16B is a plane extending in a direction of the axis O. In the first receiving part 16A and the second receiving part 16B, a plurality of bolt fixing screw holes to which a bolt 41 (described later) can be fixed are formed side by side in the axial direction Da.

As shown in FIGS. 1 to 3, the suction port 12 extends downward from the support base 11 in the vertical direction Dv. The suction port 12 has a tubular shape. A through-hole into which a suction-side protruding pipe 28A (described later) can be inserted is formed in the interior of the suction port 12. This through-hole opens to the support surface 11*f*. The suction port 12 supplies a process gas (fluid) to be compressed from the outside of the compressor 1 to the inside of a casing 21.

A discharge port 13 is provided at a position separated from the suction port 12 in the direction of the axis O. The discharge port 13 extends downward from the support base 11 in the vertical direction Dv. The discharge port 13 has a tubular shape. A through-hole into which a discharge-side protruding pipe 28B (described later) can be inserted is formed in the interior of the discharge port 13. This through-hole opens to the support surface 11*f* at a position separated from the through-hole of the suction port 12. The discharge port 13 discharges the compressed process gas from the inside of the casing 21 to the outside of the compressor 1.

The compressor main body 20 can compress the supplied fluid in the interior thereof. As shown in FIG. 1, the compressor main body 20 includes the casing 21, a bundle 22, the suction-side protruding pipe (protruding pipe) 28A, and the discharge-side protruding pipe (protruding pipe) 28B.

The casing 21 has a tubular shape extending in the direction of the axis O. The casing 21 covers the bundle 22 from an outer peripheral side. The casing 21 has a cylindrical shape in which end portions on both sides in the axial direction Da are open with a central axis disposed in the same manner as the axis O of the rotor 23 (described later) as the center. The casing 21 cannot be divided into upper and lower parts in the vertical direction Dv and is formed as an integral tubular body. Here, the casing 21 may be formed by integrally joining a plurality of materials by welding or the like.

The bundle 22 is accommodated in the casing 21. The bundle 22 of the present embodiment has a rotor 23, a bearing part 24, a plurality of diaphragms 25, and a plurality of heads 27. In the bundle 22, the rotor 23, the bearing part 24, the plurality of diaphragms 25, and a pair of the heads 27 are integrally movable.

The rotor 23 is rotatable with the axis O as the center. The rotor 23 includes a rotor shaft 231 that extends in the axial direction Da with the axis O as the center, and a plurality of impellers 232 that rotates together with the rotor shaft 231.

The impeller 232 is fixed to the outer peripheral surface of the rotor shaft 231. The impeller 232 compresses the process gas using centrifugal force by rotating together with the rotor shaft 231. The impeller 232 is provided in a plurality of stages in the axial direction Da with respect to the rotor shaft 231. The impeller 232 is a so-called open type impeller including a disk and a blade.

The bearing part 24 rotatably supports the rotor shaft 231 with the axis O as the center. The bearing part 24 is fixed to the heads 27 (described later). The bearing part 24 has a pair of journal bearings 241 each of which is provided at both ends of the rotor shaft 231, and a thrust bearing 242 provided at one end of the rotor shaft 231.

The pair of journal bearings 241 plays a role of receiving a load in the radial direction Dr acting on the rotor shaft 231. The journal bearings 241 are respectively fixed to the heads 27 using detachable fixing means (not shown) such as a bolt.

The thrust bearing 242 plays a role of receiving a load in the axial direction Da acting on the rotor shaft 231. The thrust bearing 242 is mounted to the interior of a box-shaped bearing cover 243. The bearing cover 243 is fixed to one head 27 using detachable fixing means such as a bolt.

The diaphragm 25 is disposed so as to cover the rotor 23 from the outer side in the radial direction. The diaphragm 25 has a ring shape with the axis O as the center. The annular diaphragm 25 has an upper half diaphragm 251 that forms a semi-ring shape on the upper side in the vertical direction Dv and a lower half diaphragm 252 that forms a semi-ring shape on the lower side in the vertical direction Dv with respect to the axis O of the rotor 23. The upper half diaphragm 251 and the lower half diaphragm 252 are fixed by detachable fixing means such as a bolt. The plurality (five in the present embodiment) of diaphragms 25 is arranged so as to be stacked in the axial direction Da. The plurality of diaphragms 25 is fixed to each other to form a tubular shape that extends in the axial direction Da as a whole.

The pair of heads 27 is a ring-shaped member, and is formed to have a size capable of closing and opening the openings at both ends of the casing 21. Both end portions of the rotor shaft 231 are inserted into the heads 27, respectively. As the heads 27 of the present embodiment, a suction-side head 271 disposed on one side (first side) in the axial direction Da with respect to the plurality of diaphragms 25 and a discharge-side head 272 disposed on the other side (second side) in the axial direction Da with respect to the plurality of diaphragms 25 are provided.

The suction-side head 271 forms a suction opening 291 together with an inlet wall 255 which is the diaphragm 25 disposed on one side farthest from the other side in the axial direction Da. A suction-side head exterior surface 271*f* that faces one side of the suction-side head 271 in the axial direction Da faces the outside of the compressor main body 20.

The discharge-side head 272 forms a discharge opening 293 together with a final stage diaphragm 256 which is the diaphragm 25 disposed on the other side farthest from the one side in the axial direction Da. The discharge-side head 272 of the present embodiment includes an outlet wall 275 that forms part of the discharge opening 293 and a discharge-side head main body 276 that is fixed to the outlet wall 275.

The discharge-side head main body 276 is adjacent to the other side of the outlet wall 275 in the axial direction Da. A discharge-side head exterior surface 276*f* that faces the other side of the discharge-side head main body 276 in the axial direction Da faces the outside of the compressor main body 20. Therefore, both ends of the bundle 22 in the axial direction Da are exposed to the outside of the casing 21.

As shown in FIGS. 2 and 3, on the outer peripheral surface of the casing 21, the first flange part (flange part) 26A and the second flange part (flange part) 26B are formed at both ends in the circumferential direction Dc. When viewed from the axial direction Da, the first flange part 26A and the second flange part 26B protrude in the horizontal direction Dh from the casing 21 toward the outer side in the radial direction Dr at the center in the vertical direction Dv. The first flange part 26A and the second flange part 26B extend long in the direction of the axis O. The first flange part 26A is placed on the first receiving part 16A. The second flange part 26B is placed on the second receiving part 16B.

As shown in FIGS. 1 and 2, each of the suction-side protruding pipe 28A and the discharge-side protruding pipe 28B has a tubular shape. The suction-side protruding pipe 28A and the discharge-side protruding pipe 28B protrude outward from the outer peripheral surface of the casing 21. The suction-side protruding pipe 28A and the discharge-side protruding pipe 28B of the present embodiment are formed integrally with the casing 21. The suction-side protruding pipe 28A and the discharge-side protruding pipe 28B extend downward from the lower end of the casing 21 in the vertical direction Dv. The suction-side protruding pipe 28A and the discharge-side protruding pipe 28B allow a communication between the inside and the outside of the casing 21. The interior of the suction-side protruding pipe 28A communicates with the suction opening 291. The suction-side protruding pipe 28A is formed in a shape that can be inserted into the suction port 12. Specifically, the suction-side protruding pipe 28A is shaped so that the outer peripheral surface thereof is in sliding contact with the inner peripheral surface of the suction port 12, when moving in the vertical direction Dv. The discharge-side protruding pipe 28B communicates with the discharge opening 293. The discharge-side protruding pipe 28B is formed in a shape that can be inserted into the discharge port 13. Specifically, the discharge-side protruding pipe 28B is shaped so that the outer peripheral surface thereof is in sliding contact with the inner peripheral surface of the discharge port 13, when moving in the vertical direction Dv.

As shown in FIG. 1, an annular suction-side seal member (seal member) 30A is provided between the inner peripheral surface of the suction port 12 and the outer peripheral surface of the suction-side protruding pipe 28A. The suction-side seal member 30A seals between the suction port 12 and the suction-side protruding pipe 28A. The suction-side seal member 30A is, for example, an O-ring fixed to the outer peripheral surface of the suction-side protruding pipe 28A.

An annular discharge-side seal member (seal member) 30B is provided between the inner peripheral surface of the discharge port 13 and the outer peripheral surface of the discharge-side protruding pipe 28B. The discharge-side seal member 30B seals between the discharge port 13 and the discharge-side protruding pipe 28B. The discharge-side seal member 30B is, for example, an O-ring fixed to the outer peripheral surface of the discharge-side protruding pipe 28B.

As shown in FIG. 3, such a compressor main body 20 is configured such that a lower surface of the casing 21 facing downward in the vertical direction Dv is supported on the support surface 11*f* by fitting the lower part of the casing 21 into the recess 14 of the base 10.

The connecting part 40 detachably connects the compressor main body 20 and the base 10 to each other. The compressor main body 20 connects the first flange part 26A and the first receiving part 16A to each other and connects the second flange part 26B and the second receiving part 16B to each other. The first flange part 26A and the first receiving part 16A are fixed to each other and the second flange part 26B and the second receiving part 16B are fixed to each other by a plurality of bolts 41 as the connecting part 40.

As shown in FIG. 1, in such a the compressor main body 20, as a flow path through which the process gas flows, the suction opening 291, a plurality of casing flow paths 292, and the discharge opening 293 are formed in order from an upstream side which is one side (first side) in the axial direction Da. The suction opening 291, the plurality of casing flow paths 292, and the discharge opening 293 are defined by the diaphragm 25 and the head 27.

The suction opening 291 allows the process gas flowing in from the outside through the suction-side protruding pipe 28A from the suction port 12 to flow into the casing flow path 292 in the interior of the diaphragm 25. The suction opening 291 allows the process gas to flow into the most upstream impeller 232. For example, an inlet guide vane may be provided in the suction opening 291.

The casing flow path 292 is formed in the diaphragm 25. The casing flow path 292 supplies the process gas from the suction opening 291 to the most upstream impeller 232, supplies the process gas discharged from the upstream impeller 232 to the impeller 232 disposed downstream, or supplies the process gas discharged from the most downstream impeller 232 to the discharge opening 293.

The discharge opening 293 discharges the process gas flowing through the interior of the diaphragm 25 from the discharge-side protruding pipe 28B to the outside through the discharge port 13. The discharge opening 293 discharges the process gas discharged from the most downstream impeller 232 to the outside.

Figure 4:
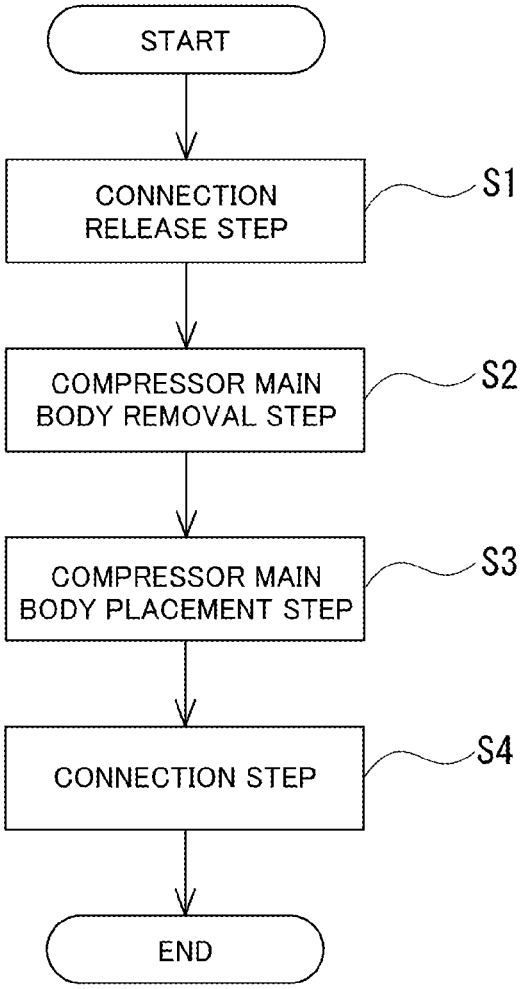
FIG. 4 is a flowchart showing a flow of a maintenance method of the compressor according to the embodiment of the present invention.
Figure 5:
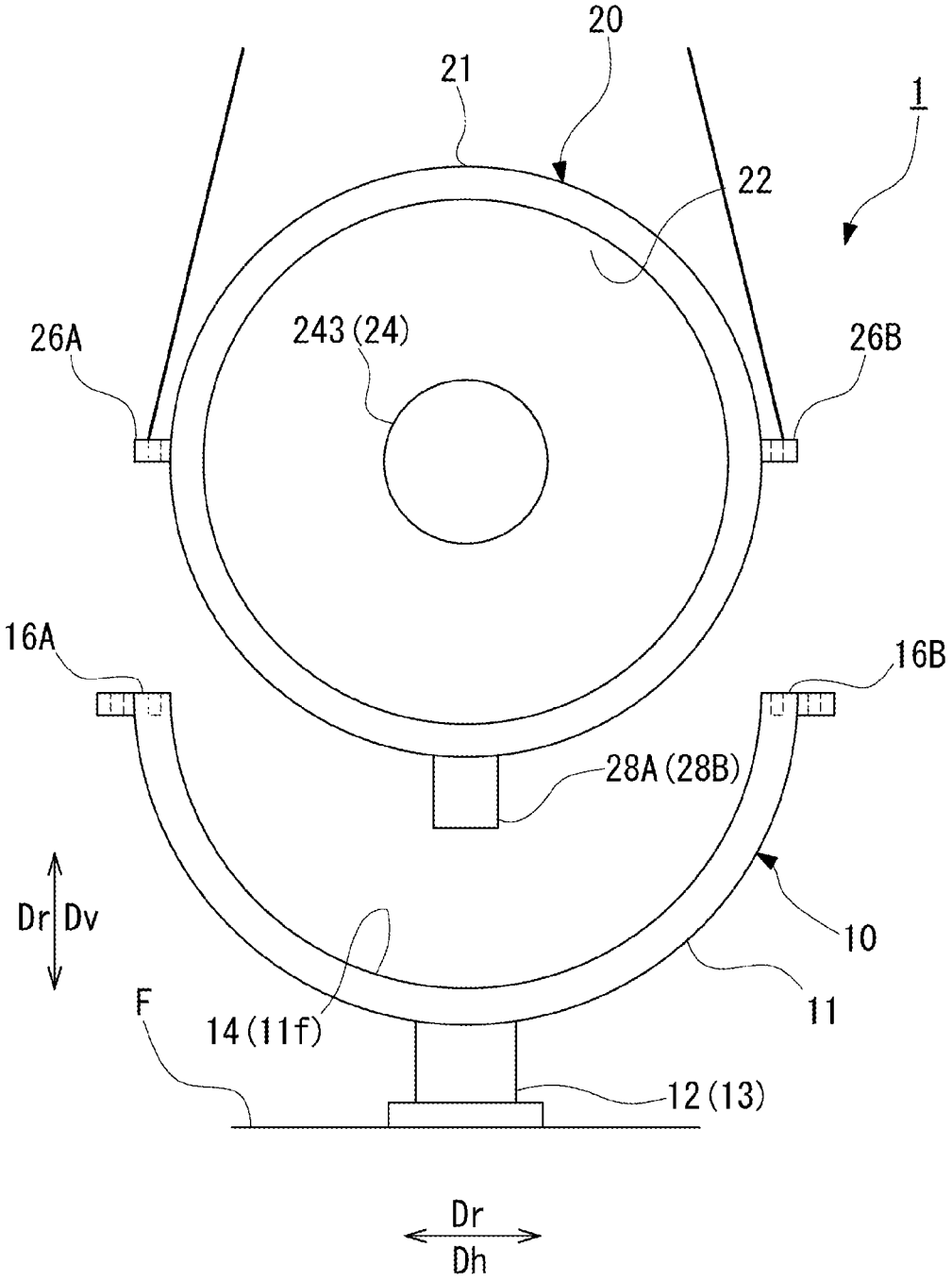
FIG. 5 is a side view schematically showing a state where a compressor main body is removed from a base in the compressor according to the embodiment of the present invention.

Next, a maintenance method for the compressor 1 according to the present embodiment will be described. FIG. 4 is a flowchart showing a flow of a maintenance method of the compressor according to the embodiment of the present invention. FIG. 5 is a side view schematically showing a state where a compressor main body is removed from a base in the compressor according to the embodiment of the present invention.

As shown in FIG. 4, the maintenance method for the compressor 1 of the present embodiment includes a connection release step S1, a compressor main body removal step S2, a compressor main body placement step S3, and a connection step S4.

In the connection release step S1, the connection between the compressor main body 20 and the base 10 in the connecting part 40 is released. Specifically, in the first flange part 26A and the first receiving part 16A and in the second flange part 26B and the second receiving part 16B, the plurality of bolts 41 is extracted, respectively.

In the compressor main body removal step S2, as shown in FIG. 5, the compressor main body 20 is lifted by a crane device or the like to be removed from the base 10. In this way, only the base 10 is left on the foundation F of the compressor 1. The compressor main body 20 removed from the base 10 is loaded on a container, a trailer, or the like, and is transported to a factory or the like that performs a maintenance work on the compressor main body 20.

In the compressor main body placement step S3, the compressor main body 20 that has been subjected to maintenance is suspended from above by a crane device or the like and placed on the support surface 11*f* of the base 10. In this case, the lower part of the casing 21 of the compressor main body 20 is inserted into the recess 14. Further, the suction-side protruding pipe 28A of the compressor main body 20 is inserted into the suction port 12 from above, and the discharge-side protruding pipe 28B is inserted into the discharge port 13 from above. Thereafter, the first flange part 26A is placed on the first receiving part 16A, and the second flange part 26B is placed on the second receiving part 16B.

Incidentally, it is preferable to use a spare compressor main body 20, which is different from the compressor main body 20 removed in the compressor main body removal step S2, as the compressor main body 20 that has been subjected to maintenance to be placed on the base 10 in the compressor main body placement step S3. The spare compressor main body 20 is a compressor main body that has been subjected to a predetermined maintenance work in advance in a factory or a newly manufactured compressor main body. In this way, it is possible to shorten the time interval between the compressor main body removal step S2 and the compressor main body placement step S3.

The compressor main body 20 removed in the compressor main body removal step S2 is subjected to a predetermined maintenance work in a factory or the like, and then is mounted again on a container or a trailer and transported to a place where the compressor 1 is installed. Thereby, the transported compressor main body 20 may be placed on the base 10 in the compressor main body placement step S3.

In the connection step S4, as shown in FIG. 3, the compressor main body 20 and the base 10 are connected to each other by the connecting part 40. For this purpose, the first flange part 26A and the first receiving part 16A are fixed to each other and the second flange part 26B and the second receiving part 16B are fixed to each other by the plurality of bolts 41. In this way, maintenance of the compressor 1 is completed.

According to the compressor 1 as described above, the compressor main body 20 is supported on the support surface 11*f* of the base 10 fixed to the foundation F. Therefore, during maintenance, the compressor main body 20 can be removed directly from the base 10 by being lifted from the support surface 11*f* of the base 10. In this way, when removing the compressor main body 20, there is no need to remove other components such as an upper half casing from the compressor main body, or to move the compressor main body 20 in the horizontal direction. As a result, a space that has to be secured for maintenance around the compressor 1 can be reduced. Further, since the compressor main body 20 removed from the base 10 includes the tubular casing 21, handling such as transportation can be easily performed. As a result, the compressor main body 20 can perform a maintenance work in a factory different from the installation place. When the compressor main body 20 is mounted to the base 10, in a case where the suction-side protruding pipe 28A and the discharge-side protruding pipe 28B are inserted into the suction port 12 and the discharge port 13, the flow path of the process gas compressed in the compressor main body 20 is connected to the foundation F side. Therefore, the compressor can be used after maintenance without performing a complicated connection work to the foundation F. Thus, maintainability of the compressor 1 can be improved.

The suction-side seal member 30A and the discharge-side seal member 30B can prevent the process gas from leaking from between the suction-side protruding pipe 28A and the suction port 12 or between the discharge-side protruding pipe 28B and the discharge port 13.

When the compressor main body 20 is placed on the base 10, positioning in the horizontal direction Dh orthogonal to the axial direction Da can be performed only by fitting the lower part of the casing 21 of the compressor main body 20 into the recess 14. Therefore, the compressor main body 20 can be easily positioned with respect to the base 10.

Further, the first flange part 26A is placed on the first receiving part 16A and the second flange part 26B is placed on the second receiving part 16B, whereby the compressor main body 20 can be positioned with respect to the base 10 on the vertical direction Dv. That is, alignment adjustment of the compressor main body 20 with respect to the foundation F can be easily performed.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description and is only limited by the scope of the appended claims.

For example, although the recess 14 and the support surface 11*f* of the base 10 are formed in a semi-arc shape, the present invention is not limited to this. The recess 14 and the support surface 11*f* may have any shape as long as the shape corresponds to the shape of the lower part of the compressor main body 20. For example, in a case where the lower part (lower surface) of the compressor main body 20 is planar, the support surface 11*f* may be planar so as to face the lower part of the compressor main body 20. In this case, the recess 14 does not need to be formed.

Further, the structure of the compressor main body 20 is not limited at all, and can be changed as appropriate. For example, the casing 21 may have a structure that can be divided into upper and lower parts in the vertical direction Dv.

Further, as in the present embodiment, the connection pipe is not limited to the suction port 12 and the discharge port 13, and other pipes through which the fluid flowing through the interior of the compressor main body 20 flows may be provided as the connection pipe corresponding to the protruding pipe provided in the compressor main body 20. For example, in a case where the compressor main body 20 is a bleed type, a bleed air pipe may be provided as a connection pipe.

EXPLANATION OF REFERENCES

1: compressor
10: base
11: support base
11*f*: support surface
12: suction port (connection pipe)
13: discharge port (connection pipe)
14: recess
16A: first receiving part (receiving part)
16B: second receiving part (receiving part)
20: compressor main body
21: casing
22: bundle
23: rotor
24: bearing part
25: diaphragm
26A: first flange part (flange part)
26B: second flange part (flange part)
27: head
28A: suction-side protruding pipe (protruding pipe)
28B: discharge-side protruding pipe (protruding pipe)
30A: suction-side seal member (seal member)
30B: discharge-side seal member (seal member)
40: connecting part
41: bolt
231: rotor shaft
232: impeller
241: journal bearing
242: thrust bearing
243: bearing cover
251: upper half diaphragm
252: lower half diaphragm
255: inlet wall
256: final stage diaphragm
271: suction-side head
271*f*: suction-side head exterior surface
272: discharge-side head
275: outlet wall
276: discharge-side head main body
276*f*: discharge-side head exterior surface
291: suction opening
292: casing flow path
293: discharge opening
Da: axial direction
Dc: circumferential direction
Dh: horizontal direction
Dr: radial direction
Dv: vertical direction
F: foundation
O: axis
S1: connection release step
S2: compressor main body removal step
S3: compressor main body placement step
S4: connection step

What is claimed is:

1. A compressor comprising:
a compressor main body;
a base that is fixed on a foundation and supports the compressor main body from below in a vertical direction; and
a connecting part that detachably connects the compressor main body and the base to each other,
wherein the compressor main body includes
a tubular casing,
a rotor that is provided within the tubular casing and is rotatable around an axis,
a bearing part that rotatably supports the rotor with respect to the tubular casing, and
a protruding pipe that allows a communication between an inside and an outside of the tubular casing and protrudes outward from an outer peripheral surface of the tubular casing, and
the base includes
a support base having a support surface for supporting a lower part of the tubular casing, and
a connection pipe that extends downward from the support base in the vertical direction and has a through-hole into which the protruding pipe is insertable.

2. The compressor according to claim 1, further comprising:
a seal member that seals between an outer peripheral surface of the protruding pipe and an inner peripheral surface of the connection pipe.

3. The compressor according to claim 2,
wherein the base further includes a recess that is recessed downward in the vertical direction and into which the tubular casing is fitted, and
the support surface is formed at least on part of the recess.

4. The compressor according to claim 3, wherein the tubular casing has a pair of flange parts protruding from the outer peripheral surface in a horizontal direction, and the base has a pair of receiving parts on which the pair of flange parts is placed.

5. The compressor according to claim 2, wherein the tubular casing has a pair of flange parts protruding from the outer peripheral surface in a horizontal direction, and the base has a pair of receiving parts on which the pair of flange parts is placed.

6. The compressor according to claim 1, wherein the base further includes a recess that is recessed downward in the vertical direction and into which the tubular casing is fitted, and the support surface is formed at least on part of the recess.

7. The compressor according to claim 6, wherein the tubular casing has a pair of flange parts protruding from the outer peripheral surface in a horizontal direction, and the base has a pair of receiving parts on which the pair of flange parts is placed.

8. The compressor according to claim 1, wherein the tubular casing has a pair of flange parts protruding from the outer peripheral surface in a horizontal direction, and the base has a pair of receiving parts on which the pair of flange parts is placed.

* * * * *